United States Patent [19]

Martin

[11] Patent Number: 4,991,896

[45] Date of Patent: Feb. 12, 1991

[54] GOLF BALL RETRIEVER

[76] Inventor: E. Ralph Martin, 735 Kentucky Dr., Rochester, Mich. 48063

[21] Appl. No.: 338,574

[22] Filed: Apr. 17, 1989

[51] Int. Cl.[5] ..... A63B 47/02

[52] U.S. Cl. ..... 294/19.2; 414/440

[58] Field of Search ..... 294/19.2, 51, 52, 53.5, 294/66.1; 56/328.1, 400.01-400.04, 400.11, 400.13; 171/58, 63; 414/437, 439, 440

[56] References Cited

U.S. PATENT DOCUMENTS

| | | | |
|---|---|---|---|
| 2,365,540 | 12/1944 | Fonken | 56/328.1 X |
| 3,614,149 | 10/1971 | Clark | 294/19.2 |
| 3,717,371 | 2/1973 | Halone | 294/19.2 |
| 3,788,506 | 1/1974 | Lee | 171/58 X |
| 3,995,759 | 12/1976 | Hollrock et al. | 414/440 |
| 4,318,654 | 3/1982 | Lee | 414/440 |
| 4,493,503 | 1/1985 | Jeninga | 294/19.2 |
| 4,593,519 | 6/1986 | Kimball | 56/328.1 |
| 4,635,987 | 1/1987 | Hurtgam | 294/19.2 |
| 4,669,770 | 6/1987 | Spielman et al. | 294/19.2 |
| 4,744,593 | 5/1988 | Spielman et al. | 294/19.2 |
| 4,761,026 | 8/1988 | Warden et al. | 294/19.2 |

*Primary Examiner*—Johnny D. Cherry
*Attorney, Agent, or Firm*—Brooks & Kushman

[57] ABSTRACT

A golf ball retriever (10) having a plurality of disks (24) spaced apart by spacer tubes (26) and secured to a rod (22) which is rolled over the bottom of a water hazard to pick up golf balls (28). The rod (22) is supported by a frame (16) which is secured to an elongated handle (12) by a pivot joint (14) which is selectively lockable in one of two positions. In its deployed position, the pivot joint (14) is locked so that the rod (22) is held perpendicular to the length of the elongated handle (12). In the storage position, the pivot joint (14) is locked to that the rod (22) is substantially parallel to the elongated handle (12) so that the golf ball retriever (10) may be easily stored in a golf bag. The golf ball retriever (10) picks up golf balls (28) in a broad strip without requiring visual guidance of the retriever (10) because golf balls (28) tend to become aligned between two disks (24) as the retriever is rolled over a golf ball.

15 Claims, 1 Drawing Sheet

GOLF BALL RETRIEVER

TECHNICAL FIELD

The present invention relates to pole mounted implements and more particularly relates to golf ball retrievers mounted on an elongated handle.

BACKGROUND

From time to time, golfers have the misfortune of losing a golf ball in a water hazard such as a lake or stream. Golf ball retrievers comprising devices attached to elongated or extensible shafts have been developed to help a golfer recover golf balls from water hazards. Generally, prior art devices are visually aligned with the lost ball and used to scoop the lost ball from the water hazard. Visually guided golf ball retrievers are typically ineffective it it is not possible to visually guide the retriever to the lost ball. More specifically, the problem with prior art devices is that in deep water hazards or water hazards having murky or muddy water it is not possible to recover the golf ball because it cannot be seen.

Golf ball retrievers used by golfers are most conveniently stored in the portion of the golf bag in which the golf clubs are stored. If the golf ball retriever covers a large portion of the opening in the golf bag in which the golf clubs are stored, it is not convenient for golfers to carry in the golf bag.

Conventional golf ball retrievers are designed to collect one ball at a time. Each ball is picked up individually and removed from the water hazard. If more than one ball is seen in the water hazard, the ball retriever must be repeatedly placed in the water hazard for each ball.

It is one objective of the present invention to provide a golf ball retriever which can retrieve golf balls without visual guidance of the retriever.

Another object of the present invention is to provide a golf ball retriever which is capable of retrieving golf balls from a board section of a water hazard.

Another object of the invention is to provide a golf ball retriever which is capable of picking up a plurality of golf balls in a single pass of the retriever.

An additional object of the present invention is to provide a golf ball retriever which can cover a broad area of a water hazard and yet may be conveniently stored in a golf bag.

These objects are achieved and the above noted problems and disadvantages are overcome by the golf ball retriever of the present invention.

SUMMARY OF THE INVENTION

The present invention relates to a golf ball retriever mounted on an elongated handle. The golf ball retriever includes a frame formed by first and second diverging L-shaped prongs which have an opening adjacent the distal ends of the prongs in which a rod is received. The rod suports a plurality of disks spaced apart by spacer tube sections. The frame is pivotally joined to the handle for movement between a deployed position and a storage position. Opposite ends of the rod are received in the openings in the prongs by fasteners or other means for retaining the rod in the openings.

According to another aspect of the present invention, a golf ball retriever is disclosed in which a selectively lockable pivotable joint connects an elongated shaft to a rod support means. A plurality of disks and spacer tubes are alternately located on the rod. The rod is movable from a first position in which the rod is aligned substantially parallel to the elongated shaft for storage in a golf bag laterally adjacent the elongated shaft, and a second position in which the rod is locked substantially perpendicular to the length of the handle in which it is deployed for picking up golf balls in a path as broad as the length of the rod.

The frame is pivotable to a position in which the rod is aligned substantially parallel to the length of the handle to facilitate storage in a golf bag. At the same time, storage space limitations do not preclude the use of a golf ball retriever which is capable of clearing golf balls from a broad swath of the bottom of a water hazard equal to the width of four, five or even eight golf balls.

The golf ball retriever of the present invention operates by rolling over the bottom of a water hazard and picking up any golf balls that are encountered. The golf balls are forced between two adjacent disks and retained by the disks. It is preferred that the distance between the outer cylindrical surface of the spacer tubes and the perimeter of the disks is slightly greater than the diameter of a golf ball so that a golf ball may be entirely received within the perimeter of the disks. The length of the spacer tubes between adjacent disks is slightly less than the diameter of a golf ball. A golf ball is contacted by the disks and it is shifted laterally until it is centered between two disks. The golf ball then deflects the disks axially outwardly at the radial point at which the golf ball enters between the two disks. The disks are resilient and, upon being deflected axially outwardly, exert a a compressive force on the golf ball to hold the golf ball between the two disks. The disks rotate either independently of or in conjunction with the rod and spacers so that a rolling contact with the bottom of the water hazard is maintained.

The golf ball retriever of the present invention is operative even where silt deposits of considerable thickness have accumulated at the base of a water hazard. The disks penetrate the silt and pick up any golf balls that may be mired in the silt.

The disks are preferably formed of sheet aluminum and the spacer tubes are formed from aluminum tubing. Alternatively, the disks and spacer tubes may be formed from resilient and relatively rigid plastic.

The present invention will be better understood upon review of the attached drawing in light of the following detailed description of the invention.

DETAILED DESCRIPTION

Figure 1:
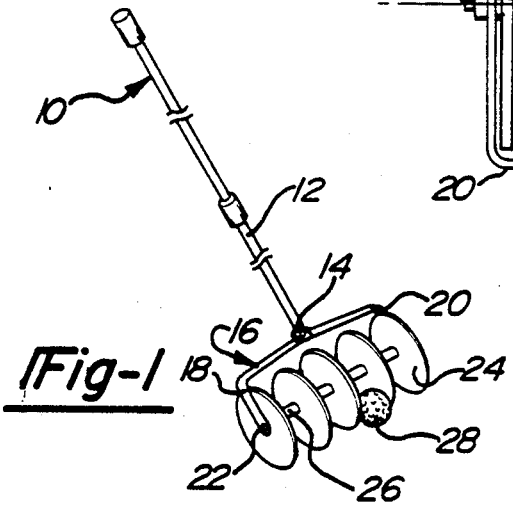
FIG. 1 is a perspeective view of the golf ball retriever of the present invention as it engages a golf ball.

Referring now to FIGS. 1 through 4, the golf ball retriever 10 of the present invention is shown.

The golf ball retriever 10 includes a handle 12, or elongated extensible shaft, which is connected by a pivot joint 14 to a frame 16. The frame preferably includes first and second prongs 18 and 20 which extend from opposite lateral sides of the pivot joint 14. First and second prongs may be separate pieces or combined in one piece, if desired. The first and second prongs 18 and 20 support a rod 22. The rod in turn supports a series of five disks 24 which are spaced apart by four spacer tubes 26.

The golf ball retriever 10 of the present invention is rolled over a golf ball 28 as shown in FIG. 1, causing the golf ball 28 to become lodged between two adjacent disks 24. As the golf ball enters the space between the two adjacent disks 24, the disks are deflected outwardly slightly. The disks are preferably formed of sheet aluminum, and exhibit sufficient resiliency to exert a compressive force on the golf ball in response to the golf ball deflecting the two disks axially outwardly.

The length of the spacer tubes 26 is preferably slightly less than the diameter of a standard golf ball 28. The length of the spacer tubes 26 is fairly critical and is preferably about 1.625 inches in length. The spacer tubes may be formed by cutting ½ inch O. D. and ¼ inch I. D. aluminumum to the desired length. The disks are aluminum sheet metal preferably between 4 and 4 ½ inches in outer diameter and have a thickness of about 0.032 inches. The spacer tues and disks are supported on a ¼ inch diameter aluminum tie bar having threading at both ends. Alternatively, the disks, spacer tubes, frame and other component parts can be made of plastic instead of aluminum.

The handle 12 is preferably a telescopic tubular member which is extensible and lockable at the desired length. Such telescopic handles are well-known and widely used on golf ball retrievers.

The pivot joint 14 will be described more specifically with reference to FIGS. 2 and 3. A tang 30 is provided on the end of the handle 12. The tang 30 includes a hole 32. A yoke 34 is secured to the frame 16 and extends toward the handle 12. The yoke includes holes 36 which are aligned with the hole 32 in the tang 30 when the tang 30 is insertd in the yoke 34. The joint is preferably secured together by means of a bolt 38 which is preferably retained by means of wing nut 40 to facilitate selective locking of the pivot joint 14 in its deployed and storage positions. In the deployed position, the rod 22 is substantially perpendicular to the elongated handle 12. In the storage position, the rod 22 is substantially parallel to and partially adjacent the elongated handle 12. As used herein, the term "substantially" is intended to be in sense of an approximate alignment and not in a strict geometric sense. For example, the degree of parallelism between the rod 22 and the shaft 12 is that required to limit the space required to store the apparatus in a golf bag. The frame 16 preferably is rotatable at least 90 degrees between the deployed and storage positions.

Figure 2:
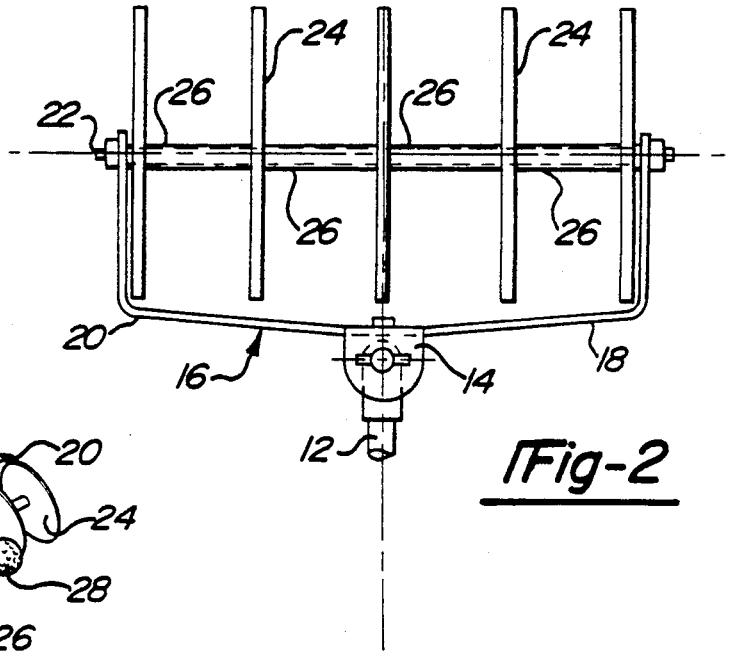
FIG. 2 is a fragmentary plan view of the golf ball retriever of the present invention.
Figure 3:
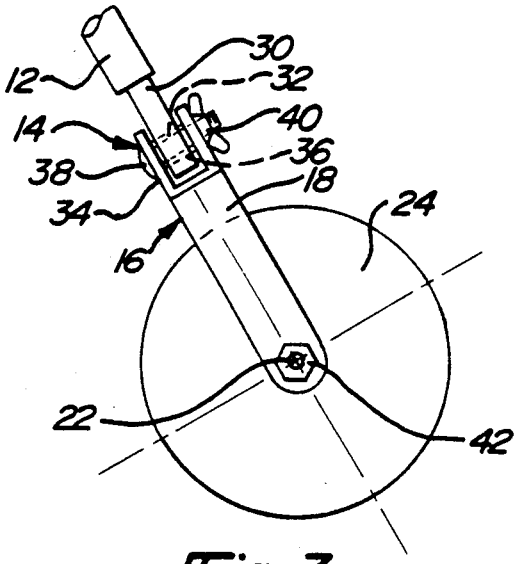
FIG. 3 is a fragmentary side elevational view of the golf ball retriever of the present invention.
Figure 4:
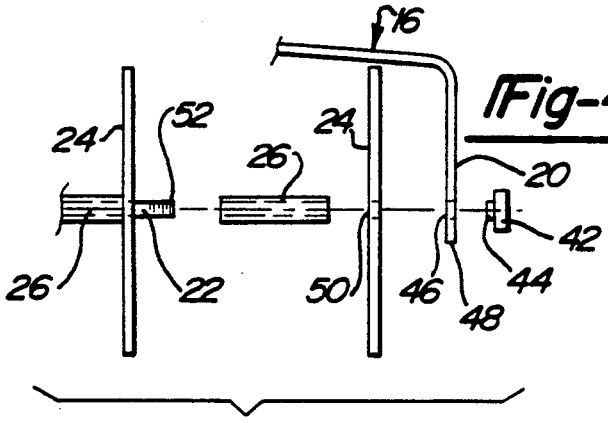
FIG. 4 is a fragmentary exploded perspective view of one end of the golf ball retriever of the present invention.

Referring now to FIGS. 2 through 4, assembly of the rod 22, disks 24 and spacer tubes 26 will be described in more detail. One prong 20 of the frame 16 is shown in FIG. 4 with the rod partially assembled. The rod 22 extends through a series of spacer tubes 26, and it is connected to the frame by a bearing nut 42. The bearing nut 42 is a specialized fastener having a cylindrical bearing surface 44 which is received within an opening 46 at the distal end 48 of the prong 20. The rod extends through a hole 50 in each of the disks 24. The threaded end 52 of the rod 22 receives the bearing nut 42, thereby securing the rod 22 to the frame 16. A bearing nut 42 is provided on both ends of the rod 22. The disks must be tightly retained in the frame to maintain the optimum compressive force on a golf ball so that it may be picked up with ease.

Figure 5:
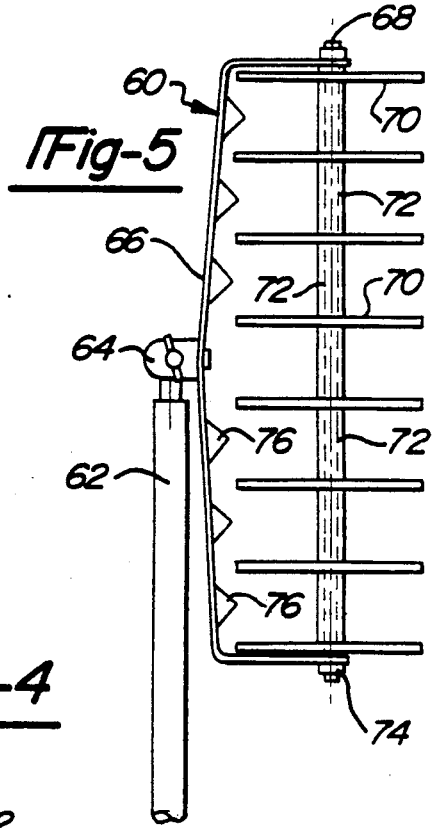
FIG. 5 is an alternative embodiment of the golf ball retriever of the present invention shown with the frame in the storage position.

Referring now to FIG. 5, an alternative embodiment of the invention 60 is shown wherein a broader ball recovery area is provided. In the alternative embodiment 60, a handle 62 of the elongated telescopic type is connected by a pivot joint 64 to a frame 66. The frame is longer than the frame of the previous embodiment, but is otherwise substantially similar to that of the embodiment of FIGS. 1 through 4. Rod 68 is retained by the frame 66 and supports eight disks 70 which are separated by seven spacer tubes 72. The rod 68 is retained in the frame 66 by bearing nuts 74 which lock the opposite ends of the rod 68 to the frame 66. A tooth 76 may be provided on the inner side of the frame 66 to cause a golf ball to be forced into the space between adjacent disks 70 as it rotates through the frame 66. The teeth 76 aid in locking golf balls between the disks 70.

The preceding description of two preferred embodiments of the present invention is intended to be illustrative of two preferred forms of the invention. It is anticipated that the disks and the spacer tubes may be molded or fabricated from plastic. Other modifications and enhancements of the present invention will be apparent based upon the above description. The scope of the present invention should be measured by the following claims, and not limited by the above description of the preferred embodiments.

I claim:

1. A golf ball retriever comprising: an elongated handle;

a frame formed by first and second diverging L-shaped prongs, each of said prongs having an opening adjacent a distal end thereof;

a pivot joint securing one end of said handle to said frame;

a rod retained in said openings of said prongs;

a plurality of disks located between said prongs, each of said disks having a central hole for receiving said rod, said disks being rotatable relative to said frame;

a plurality of spacer tubes, each of said spacer tubes being disposed between two disks;

nut bearings secured to said rod adjacent said openings for retaining said rod in said openings; and said frame being pivotable between a first position in which said rod is aligned substantially parallel to the handle for storage in a golf bag laterally adjacent said handle in a space equal to the diameter of said disks and the lateral distance between the disks and the pivot joint, and a second position in which said rod is substantially perpendicular to the length of said handle for picking up golf balls in a path as substantially as broad as the length of said rod.

2. The golf ball retriever of claim 1 wherein the distance between an outer cylindrical surface of said spacer tubes and the perimeter of said disks is slightly greater than the diameter of a golf ball.

3. The golf ball retriever of claim 1 wherein the length of said spacer tubes is slightly less than the diameter of a golf ball.

4. The golf ball retriever of claim 3 wherein the disks are clamped together on said rod by said spacer tubes and rotatable on said rod to be rolled over the bottom of a body of water, wherein when a golf ball is contacted by said disks the golf ball is shifted laterally until it is centered between two disks, said disks deflecting axially outwardly at the radial point at which the golf ball enters between said two disks.

5. The golf ball retriever of claim 4 wherein said two disks are resilient and upon being deflected axially outwardly exert a compressive force on the golf ball to hold the golf ball between said two disks.

6. The golf ball retriever of claim 1 wherein said disks are formed from sheet metal and said spacer tubes are formed from metal tubing.

7. The golf ball retriever of claim 1 wherein said pivot joint comprises a bolt and wing nut.

8. A golf ball retriever comprising:

an elongated shaft;

A selectively lockable pivotable joint moveable between first and second positions and connected to one end of said shaft;

a head connected to said pivotable joint;

a rod supported solely at two spaced ends by said head;

at least three disks retained on said rod between said two spaced ends of said rod;

a plurality of spacer tubes disposed on said rod between said disks, in an arrangement of alternating disks and spacer tubes clamped in engagement within the head and between nut bearings secured on said rod;

wherein said head is movable from the first position of said joint in which said rod is aligned substantially parallel to the elongated shaft for storage in a golf bag laterally adjacent said shaft in a space equal to the diameter of said disks and the lateral distance between the disks and the pivotable joint, to the second position of said joint in which said rod is substantially perpendicular to the length of said shaft for picking up golf balls in a path substantially as broad as the length of said rod.

9. The golf ball retriever of claim 8 wherein the distance between an outer cylindrical surface of said spacer tubes and the perimeter of said disks is slightly greater than the diameter of a golf ball.

10. The golf ball retriever of claim 8 wherein the length of said spacer tubes is slightly less than the diameter of a golf ball.

11. The golf ball retriever of claim 8 wherein the disks are clamped together on said rod by said spacer tubes and rotatable on said rod to be rolled over the bottom of a body of water, wherein when a golf ball is contacted by said disks the golf ball is shifted laterally until it is centered between two disks, said two disks deflecting axially outwardly at the radial point at which the golf ball enters between said two disks.

12. The golf ball retriever of claim 8 wherein said disks are resilient and two of said disks being spaced apart and being located adjacent to each other, said two disks upon being deflected axially outwardly exert a compressive force on the golf ball to hold the golf ball between said two disks.

13. The golf ball retriever of claim 8 wherein said disks are formed from sheet metal and said spacer tubes are formed from metal tubing.

14. The golf ball retriever of claim 8 wherein said disks and said spacer tubes are formed from plastic.

15. The golf ball retriever of claim 8 wherein said elongated shaft has a plurality of telescoping sections which are adjustable to change the length of said elongated shaft.

* * * * *